US007343111B2

(12) United States Patent
Itagaki

(10) Patent No.: US 7,343,111 B2
(45) Date of Patent: Mar. 11, 2008

(54) ELECTROPHOTOGRAPHIC IMAGE FORMING APPARATUS FOR FORMING TONER IMAGES ONTO DIFFERENT TYPES OF RECORDING MATERIALS BASED ON THE GLOSSINESS OF THE RECORDING MATERIALS

(75) Inventor: Seiko Itagaki, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 197 days.

(21) Appl. No.: 11/137,519

(22) Filed: May 26, 2005

(65) Prior Publication Data

US 2006/0045551 A1 Mar. 2, 2006

(30) Foreign Application Priority Data

Sep. 2, 2004 (JP) ..... 2004-255500
Oct. 26, 2004 (JP) ..... 2004-310589

(51) Int. Cl.
*G03G 15/00* (2006.01)

(52) U.S. Cl. ..... 399/45

(58) Field of Classification Search ..... 399/45, 399/50, 55, 389
See application file for complete search history.

(56) References Cited

U.S. PATENT DOCUMENTS 5,155,530 A * 10/1992 Larson et al. ..... 399/55
5,530,532 A * 6/1996 Iino et al. ..... 399/237
5,678,133 A * 10/1997 Siegel ..... 399/67
6,088,546 A * 7/2000 Inoue et al. ..... 399/45
6,301,452 B1 * 10/2001 Yoshizawa ..... 399/45
6,397,020 B1 * 5/2002 Kim ..... 399/45
6,668,144 B2 * 12/2003 Maruyama ..... 399/45
7,149,441 B2 * 12/2006 Akita et al. ..... 399/45

FOREIGN PATENT DOCUMENTS

JP 05216316 A * 8/1993
JP 11344880 A * 12/1999
JP 2000039745 A * 2/2000
JP 2000-172115 6/2000
JP 2000310892 A * 11/2000
JP 2001117263 A * 4/2001
JP 2002268318 A * 9/2002

* cited by examiner

*Primary Examiner*—Robert Beatty
(74) *Attorney, Agent, or Firm*—Finnegan, Henderson, Farabow, Garrett & Dunner, L.L.P.

(57) ABSTRACT

Disclosed in an image forming apparatus in which an electrostatic potential and/or frequency of AC voltage of development bias is controlled according to information on recording material. The information is preferably glossiness information of the recording material.

9 Claims, 4 Drawing Sheets

ELECTROPHOTOGRAPHIC IMAGE FORMING APPARATUS FOR FORMING TONER IMAGES ONTO DIFFERENT TYPES OF RECORDING MATERIALS BASED ON THE GLOSSINESS OF THE RECORDING MATERIALS

BACKGROUND OF THE INVENTION

1. Field of the Invention

The present invention relates to an image forming apparatus such as a multi-function peripheral having two or more functions of a copier, printer, scanner and facsimile, and in particular an electrophotographic image forming apparatus.

2. Description of Related Art

Generally in the electrophotographic image forming apparatus, an image is formed on a recording material as follows. An electrostatic latent image is formed on an image forming body such as a photoconductor, the formed electrostatic latent image is developed with toner to form a toner image, and the toner image formed on the photoconductor is directly transferred to a recording paper or is transferred to an intermediate transferring body and subsequently is transferred from the intermediate transfer body to the recording paper.

In the image forming process of the electrophotography, various materials are used as the recording material. That is, thin paper, board paper, glossy paper having a gloss layer on a side where an image is formed, OHT and the like are used as the recording material.

These recording materials have different properties which affect the image forming by electrophotography each other, such as conveyance property, resistance, heat capacity and the like. Thus, in developing, transferring and fixing, it is required that the conditions in the image forming are determined according to the recording materials.

For example, it is proposed in JP 2000-172115A (hereinafter referred to as patent document 1) to switch a printing sequence condition in accordance with specifying information to specify the kind of the recording material.

As for the printing sequence condition, developing sleeve circumferential velocity, development bias value, primary transferring bias value, secondary transferring bias value, secondary transferring velocity, fixing velocity and the like are given.

In patent document 1, scattering, fog and hollow of an image caused by the difference in recoding materials are prevented.

Recently, there is increasing application of the image forming apparatus as an output device of a digital camera, and there is increasing use of glossy paper as the recording material. Fog is extremely problematic in using glossy paper and it is required taking some measure for the problem of fog. This is due to the following phenomenon. In glossy paper, since melted toner is not penetrated or poorly penetrated into the recording material, the melted toner is fixed with spreading on the surface of the recording material in fixing process. Therefore, it occurs that a dot of minute area causing the fog is expanded to a dot of large area.

Due to this phenomenon, even if the fog on the photoconductor and the recording material is low, it becomes high level and may exceed permissive level after fixing process.

Above-described problem of fog after fixing process, which occurs in the case of using glossy paper having flat surface and high glossiness, becomes prominent when a high quality image are formed using toner of small particle size, because the toner of small particle size easily causes the fog.

In patent document 1, the fog prevention is controlled in accordance with differences in properties of the recording materials. However, any measure for the above-described phenomenon of fog is not employed, the phenomenon of fog is that low level fog counted for nothing before the fixing process becomes high level fog by the fixing process. Thus, prevention of fog in using glossy paper is not sufficient.

SUMMARY OF THE INVENTION

The present invention is made in the light of the above mentioned phenomenon. One of the objects of the invention is to provide a novel and improved image forming apparatus. Another object of the present invention is to improve the insufficient measures in the prior art, which deals with the difference in recording materials, and in particular to prevent the fog after fixing process even in glossy paper, and to provide an image forming apparatus which can form high quality image on glossy paper.

In order to achieve at least one of the above mentioned objects, according to one embodiment reflecting the first aspect of the invention, an image forming apparatus comprises: a photoconductor, an electrostatic charger to charge the photoconductor at a predetermined electrostatic potential, an exposing device to form an electrostatic latent image on the photoconductor by exposing the charged photoconductor, a developing device to develop the electrostatic latent image on the photoconductor with toner by applying a development bias so as to form a toner image, a transferring device to transfer the formed toner image onto a recording material, a fixing device to fix the toner image on the recording material, and a controller to control the electrostatic potential, wherein the controller controls the electrostatic potential according to information on the recording material.

Preferably, the controller controls the electrostatic potential according to glossiness information of the recording material.

Preferably, the controller controls the electrostatic potential to be higher in the case that glossiness of the recording material is high than in the case that glossiness of the recording material is low.

The glossiness information may be detected by a glossiness detection sensor which detects glossiness of the recording material, or may be input with a designating part to designate the kind of the recording materials having different glossiness each other.

Preferably, the toner has volume mean particle size of 4 μm to 8 μm.

According to another embodiment reflecting the second aspect of the invention, an image forming apparatus comprises: a photoconductor, an electrostatic charger to charge the photoconductor, an exposing device to form an electrostatic latent image on the photoconductor by exposing the changed photoconductor, a developing device to develop the electrostatic latent image on the photoconductor with toner by applying a development bias in which AC voltage is overlapped with DC voltage so as to form a toner image on the photoconductor, the development bias in which AC voltage is superimposed on DC voltage, a transferring device to transfer the formed toner image onto a recording material, a fixing device to fix the toner image on the recording material, and a controller to control the development bias, wherein the controller controls frequency of the AC voltage according to glossiness information of the recording material.

Preferably, the controller controls the electrostatic potential to be higher in the case that glossiness of the recording material is high than in the case that glossiness of the recording material is low.

The glossiness information may be detected by a glossiness detection sensor which detects glossiness of the recording material, or may be input with a designating part to designate the kind of the recording materials having different glossiness each other.

Preferably, the toner has volume mean particle size of 4 μm to 8 μm.

BRIEF DESCRIPTION OF THE DRAWINGS

These and other objects, advantages and features of the present invention will become more fully understood from the detailed description given hereinbelow and the appended drawings, and thus are not intended as a definition of the limits of the present invention, and wherein.

DETAILED DESCRIPTION OF PREFERRED EMBODIMENTS

[Image Forming Apparatus]

Figure 1:
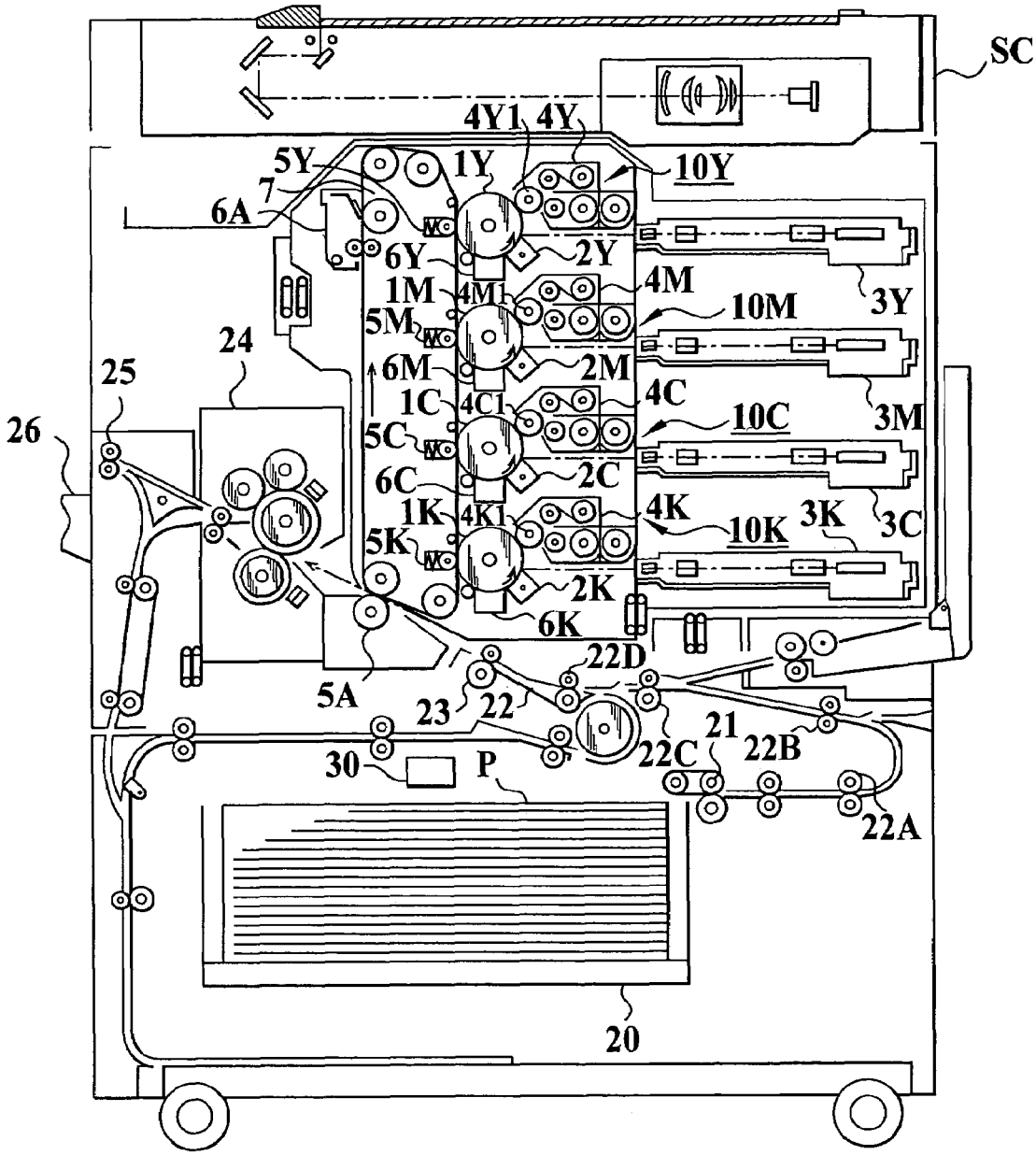
FIG. 1 shows a whole constitution of the image forming apparatus according to an embodiment of the present invention.

FIG. 1 shows a color image forming apparatus which is one of the embodiments of the present invention.

This color image forming apparatus is one referred to as a tandem color image forming apparatus, and comprises a plurality of image forming members 10Y, 10M, 10C and 10K, an intermediate transferring unit, a feeding and carrying device and a fixing device 24. A copy reading apparatus SC is installed on the top of the color image forming apparatus.

The image forming member 10Y forms an image of yellow color, and comprises an electrostatic charger 2Y placed around a photoconductor 1Y, an exposing device 3Y, a developing device 4Y, a primary transferring device 5Y and a cleaning device 6Y. The image forming member 10M forms an image of magenta color, and comprises an electrostatic charger 2M placed around a photoconductor 1M, an exposing device 3M, and developing device 4M, a primary transferring device 5M and a cleaning device 6M. The image forming member 10C forms an image of cyan color, and comprises an electrostatic charger 2C placed around a photoconductor 1C, an exposing device 3C, a developing device 4C, a primary transferring device 5C and a cleaning device 6C. The image forming member 10K forms an image of black color, and comprises an electrostatic charger 2K placed around a photoconductor 1K, an exposing device 3K, a developing device 4K, a primary transferring device 5K and a cleaning device 6K.

An intermediate transferring body 7, which is semiconductive and belt-shaped, is winded and supported by a plurality of rollers with being cyclically movable.

An image forming device composed of the electrostatic charger 2Y, exposing device 3Y and developing device 4Y performs electrostatic charge, exposure and develop on the photoconductor 1Y, so that an yellow toner image is formed on the photoconductor. Similarly, an image forming device composed of the electrostatic charger 2M, exposing device 3M and developing device 4M forms a magenta toner image on the photoconductor 1M, an image forming device composed of the electrostatic charger 2C, exposing device 3C and developing device 4C forms a cyan toner image on the photoconductor 1C, and an image forming device composed of the electrostatic charger 2K, exposing device 3K and developing device 4K forms a black toner image on the photoconductor 1K. The primary transferring devices 5Y, 5M, 5C and 5K transfer and overlap these unicolor toner images to the intermediate transferring body 7 so that multicolor toner image is formed.

A feeding device 21 feeds a recording material P housed in a recording material housing member 20 such as a feeding cassette and feeding tray, and the recording material P is carried to the secondary transferring device 5A through a plurality of intermediate rollers 22A, 22B, 22C, 22D and a resist roller 23. The secondary transferring device 5A transfers the multicolor toner onto the recording material P collectively. The fixing device 24 performs a fixing treatment to the recording material P on which the multicolor toner image have been transferred, and a ejection roller 25 carries the recording material P so as to eject it on an eject tray 26.

On the other hand, after the secondary transferring device 5A transfers a color image on the recording material P, the intermediate transferring body 7 passes through the cleaning device 6A so that residual toner is removed from the intermediate transferring body 7.

As for the photoconductors 1Y, 1M, 1C and 1K, an organic photoconductor and amorphous silicone photoconductor and the like, which are well known in the art, are used. Among them, an organic photoconductive photoconductor is preferable, and in particular, a negative-electric organic photoconductive photoconductor is preferable. In the present embodiment, a negative-electric organic photoconductive photoconductor is used.

As for the electrostatic charger 2Y, 2M, 2C and 2K, a corona charging device such as a scorotron and corotron is used, and a scorotron is preferably used.

As for the exposing devices 3Y, 3M, 3C and 3K, a light emitting element which emits light according to image data, such as laser, LED array and the like, are used.

As for the developing devices 4Y, 4M, 4C and 4K, used are a developing device using two component developer whose main ingredients are carrier and toner or a developing device using one component developer whose main ingredient is only toner without carrier. Among them, the developing device of two component developer using toner of small particle size is preferable. The technique of the present embodiment can be applied to a developing device performing discharged or charged area development. Preferable are discharged area development in which developing bias of same electric polarity as that of the photoconductor is applied to a developing sleeve 41 (shown in FIG. 4A to 4C) and the development is performed with toner having same electric polarity as that of the photoconductor. In the present embodiment, the development is performed with discharge area development using negatively charged toner.

As for the toner of small particle size, one having volume mean particle size of 4 to 8 μm is preferable.

The volume mean particle size is a mean particle size in volume standard, and is measured with "COURTER COUNTER TA-II" (made by COURTER Corp.) equipped with wet-type mill.

By using such toner of small particle size, it becomes possible to form a high-quality image of high resolution. When volume mean particle size of toner is more than 8 μm, image quality degrades.

When volume mean particle size of toner is less than 4 μm, image quality easily degrades due to fog or the like.

In the present embodiment, it is desirable to use spherical toner and the sphericity thereof is desirably 0.94 or more and 0.98 or less.

Sphericity=(Circumference of a circle having same area as that of the projection image of the particle)/(Circumference of the projection image of the particle)

The above-described sphericity can be measured as follows. Photographs of 500 resin particles are taken with a scanning electron microscope or laser microscope at a magnification of 500 times. The photographed images are analyzed with an image analyzer "SCANNING IMAGE ANALYZER" (made by JEOL, Ltd.) to measure the circularities thereof. The arithmetic average thereof is the sphericity. Further, as a simple measuring method, the sphericity can be measured with "FPIA-1000" (SYSMEX, Corp.).

When the sphericity is less than 0.94, the particles are highly stressed in the developing device and crushed. Thus, it becomes easier to occur fog or scattering of toner. Further, if the sphericity is more than 0.98, it may become difficult to maintain the cleaning property.

For the above-described toner having small particle size and high sphericity, it is desirable to use polymerization toner.

The polymerization toner means toner in which binder resin for toner and toner shape are made by polymerization of monomer or pre-polymer material of binder resin, and if required, following chemical treatment. More specifically, the toner is made by polymerization reaction such as suspension polymerization and emulsion polymerization, and if required, following fusing process for fusing the particles each other. Since the polymerization is performed to manufacture the toner after the monomer or prepolymer material is dispersed homogenously in aqueous system, the obtained toner has uniform particle size distribution and shape.

Specifically, the toner can be manufactured by suspension polymerization method or a method in which emulsion polymerization is performed for the monomer in aqueous medium including emulsifier to make polymerization particles of micro grain, and subsequently organic solvent, coagulant or the like is added thereto so that they are associated each other. Possible methods are a method in which mold release agent, coloring agent and the like required as toner composition are mixed therewith in the association, and a method in which toner composition such as mold release agent, coloring agent and the like are dispersed in the monomer before the polymerization. The association means that a plurality of resin particles or coloring agent particles are fused with each other.

A semiconductive rubber roller is used in the primary transferring devices 5Y, 5M, 5C and 5K, and secondary transferring device 5A. Transferring voltage is applied to the primary transferring devices 5 by a power supply respectively.

The cleaning devices 6A, 6Y, 6M, 6C and 6K performs cleaning with cleaning blades composed of rubber blades.

Figure 2:
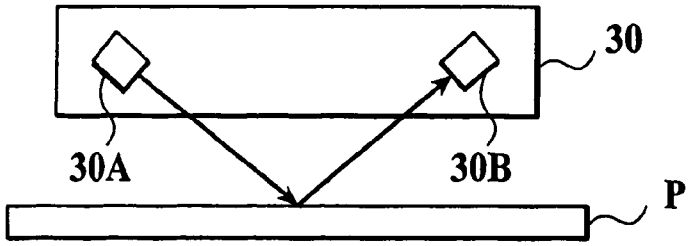
FIG. 2 shows a constitution of a glossiness detecting sensor.

The glossiness detecting sensor 30 to detect glossiness of the recording material is installed above the recording material housing member 20. As shown in FIG. 2, the glossiness detecting sensor 30 composes a light emitting element 30A such as a LED and a light receiving element 30B such as a phototransistor. The light emitting element 30A emits light beam in a certain direction, and the light receiving element 30B receives light incoming from a certain direction, i.e. has directivity.

When glossy paper having high glossiness is used as the recording material P, received light intensity by the light receiving element 30B is high since much light reflects by specular reflection. When plain paper having low glossiness is used, the received light intensity by the light receiving element 30B is low due to diffuse reflection.

Figure 3:
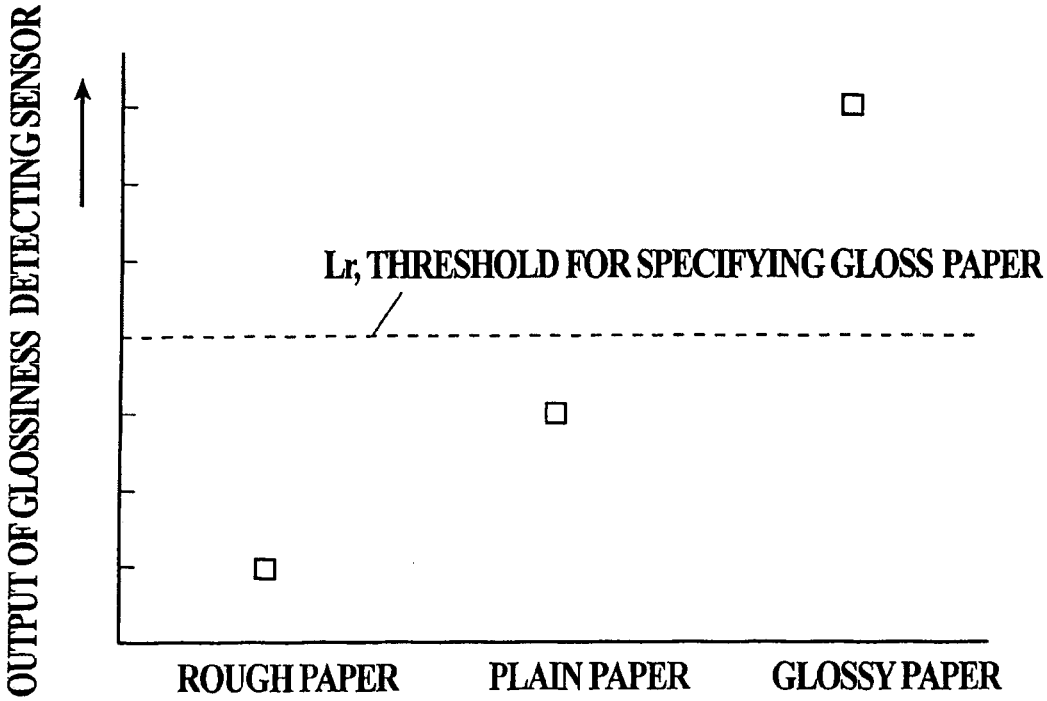
FIG. 3 shows an output property of the image detecting sensor for various recording materials.

FIG. 3 shows output variation of the glossiness detecting sensor 30 according to the glossiness difference in the recording materials P. As shown in the figure, the output properties is such that the received intensities are rough paper<plain paper<glossy paper. Threshold level Lr is set between the received intensities of plain paper and glossy paper so as to perform the control as described below.

Embodiment 1

Figure 4A:
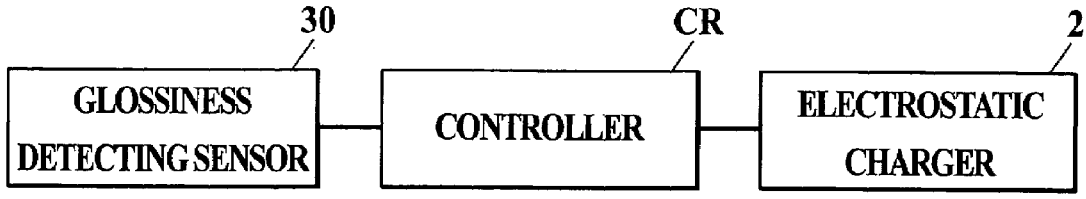
FIG. 4A to 4C are block views of a control system of the image forming apparatus according to the embodiment of the present invention.
Figure 4B:
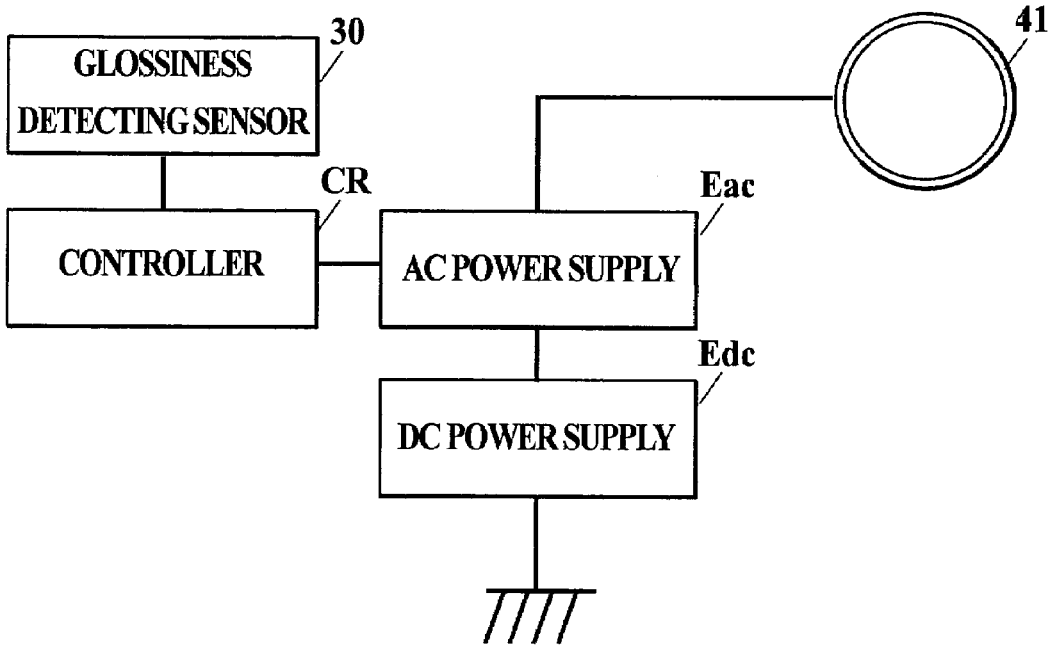
Figure 4C:
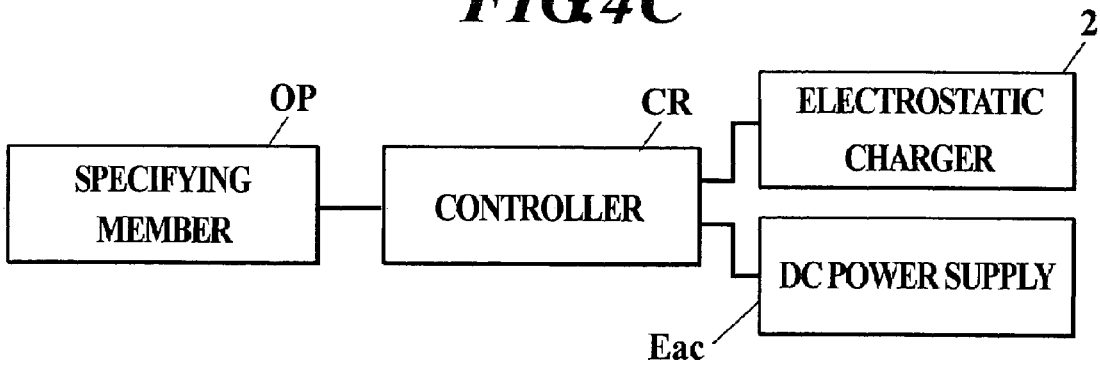

FIGS. 4A to 4C are block views of a controlling system of the image forming apparatus according to the embodiment of the present invention.

Figure 5:
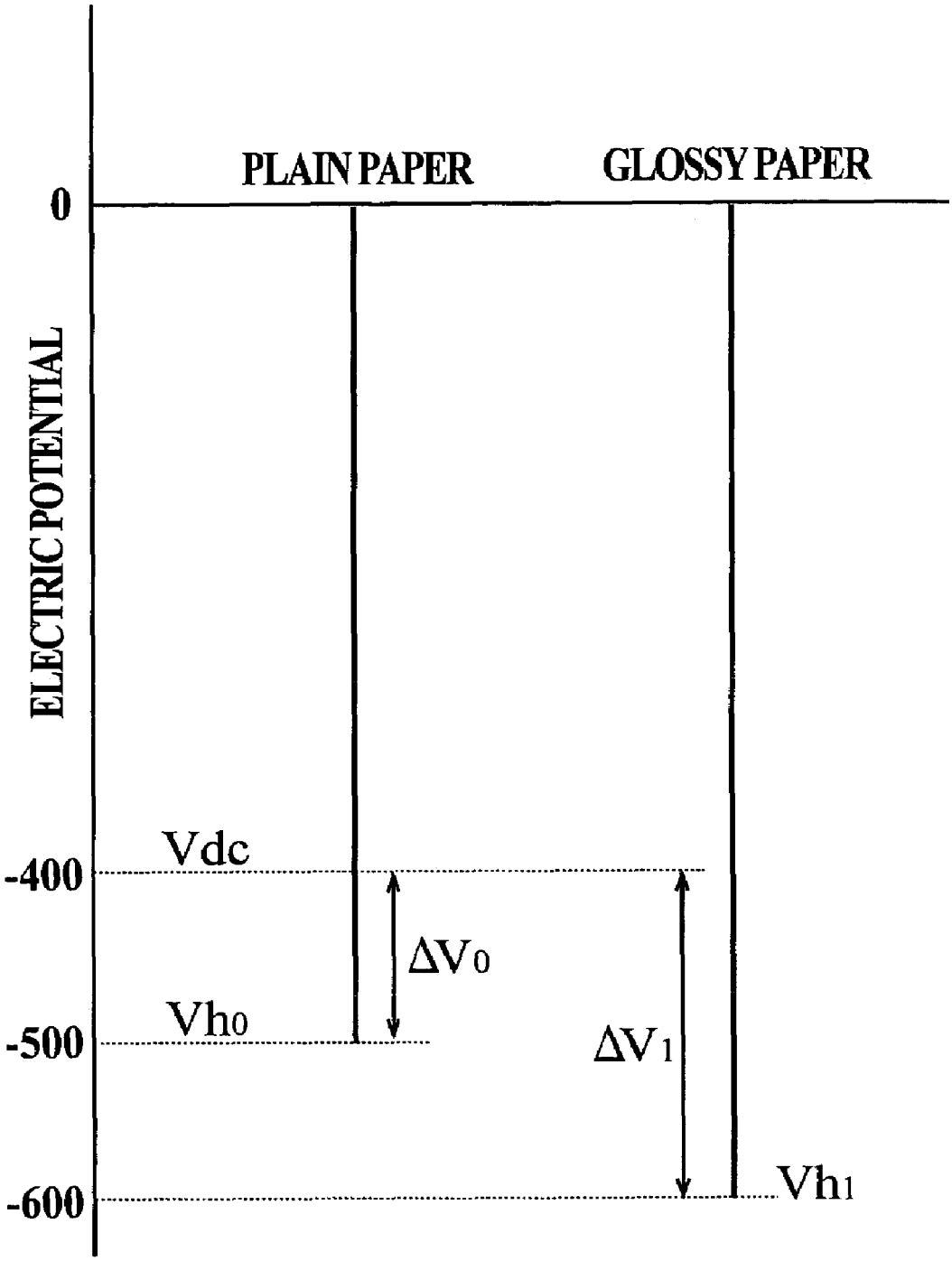
FIG. 5 shows control of fog prevention electric potential ΔV.

In embodiment 1 shown in FIG. 4A, a controller CR controls electrostatic voltage of the electrostatic charger 2 according to a detection signal detected by the glossiness detecting sensor 30 as shown in FIG. 5. That is, in the case of plain paper having low glossiness, the electrostatic potential of the photoconductors 1Y, 1M, 1C and 1K is set to Vh0. In the case of glossy paper having high glossiness, the electrostatic potential of the photoconductors 1Y, 1M, 1C and 1K is set to Vh1. The electrostatic potential Vh1 is higher than Vh0. By doing so, fog prevention electrostatic potential gets high from ΔV0 (=Vh0−Vdc) to ΔV1 (=Vh1−Vdc) and the fog in glossy paper becomes lower than that in plain paper, where the fog prevention electrostatic potential is obtained by subtracting DC bias voltage from the electrostatic potential and it is a potential at a non-image area. That is, when development field is explained with reference to FIG. 5, development bias Vdc which is positive polarity given by DC voltage works as effective development potential so that the toner is developed. ΔV is a potential at a non-image area. Since the development field of negative polarity contrary to the above development field works, the higher development field at the non-image area results less development of toner.

Specifically, the above-described control is as follows. The output of the glossiness detecting sensor 30 is discriminated by the predetermined threshold Lr shown in FIG. 3. According to the discriminating signal, the electrostatic potential Vh generated by the electrostatic charger 2 is controlled to be Vh0 or Vh1, which are electrostatic potentials respectively for plain paper and glossy paper, so that the fog prevention potential becomes ΔV0 or ΔV1 respectively.

Embodiment 2

As shown in FIG. 4B, the development bias is applied to the developing sleeve 41 of the developing devices 4Y, 4M, 4C and 4K, where the development bias is one in which DC voltage Vdc by a DC power supply Edc is overlapped with AC voltage Vac by an AC power supply Eac.

The controller CR controls frequency f of the AC voltage Vac according to the detection signal of the glossiness detecting sensor 30. That is, the controller controls the AC voltage Vac so that the frequency f is higher in the case that the recording material P is glossy paper having high glossiness than in the case that the recording material P is plain paper having low glossiness.

As a result, the fog becomes low in the case of glossy paper having high glossiness compared to the fog in the case of plain paper. Thus, the fog occurring after the fixing process, which easily occurs in glossy paper, is effectively prevented.

Embodiment 3

FIG. 4C is a block view of a controlling system according to embodiment 3 of the present invention.

This embodiment comprises an operating member OP as a designating member which enables an operator to designate the kind of recording material having various glossiness, for example, such as plain paper or glossy paper.

The controller CR controls the electrostatic charger 2 or the AC voltage power supply Eac according to the designating information set at the operating member OP by an operator.

The operator sets the kind of the recording material P to be used, such as plain paper or glossy paper, at the operating member OP. When the recording material P is glossy paper, the controller CR controls the output of the electrostatic charger 2 to be higher according to the set designating information, i.e. glossiness information, so that the fog becomes low. Further, it is also possible that the controller CR controls the AC power supply Eac and the frequency f becomes higher, so that the fog becomes low.

EXAMPLES

Example 1

The negatively charged toner having volume mean particle size of 6 μm was used. The conditions were set as follows for the development bias, and an image was formed. DC voltage Vdc=−400V, AC voltage Vac (peak to peak voltage)=1.0 kV, frequency 5 kHz and fog prevention potential ΔV as shown in Table 1.

As a result, in both plain paper and glossy paper, high quality image having no fog were obtained even after the fixing process.

TABLE 1

| RECEIVED LIGHT INTENSITY | ELECTROSTATIC POTENTIAL Vh | FOG PREVENTION POTENTIAL ΔV |
|---|---|---|
| ≧THRESHOLD Lr | −600 | 200 |
| <THRESHOLD Lr | −500 | 100 |

Example 2

The negatively charged toner having volume mean particle size of 6 μm was used. The conditions were set as follows, and an image was formed. Electrostatic potential Vh of the photoconductor=−500V, and for development bias, DC voltage Vdc=−400V, AC voltage Vac (peak to peak voltage)=1.0 kV and frequency f (kV) as shown in Table 2.

As a result, in both plain paper and glossy paper, high quality image having no fog were obtained even after the fixing process.

TABLE 2

| RECEIVED LIGHT INTENSITY | FREQUENCY OF DEVELOPMENT AC BIAS f (kHz) |
|---|---|
| ≧THRESHOLD Lr | 6 |
| <THRESHOLD Lr | 5 |

Example 3

The negative charged toner having volume mean particle size of 5 μm was used. The conditions were set as follows for the development bias, and an image was formed. DC voltage Vdc=−400V, AC voltage Vac (peak to peak voltage) =1.0 kV, frequency 5 kHz and fog prevention potential ΔV as shown in Table 1.

For comparative example, the fog prevention potential for glossy paper was set to 100V which was same as that for plain paper, and an image was formed.

In the comparative example, fog occurred in glossy paper after the fixing process as shown in Table 3. Further, a thin line was formed thicker and reproducibility of a thin line was poor.

TABLE 3

| | FOG (RELATIVE RFLECTION DENSITY) | LINE WIDTH (3 DOT LINE) |
|---|---|---|
| THE CONDITIONS CONTROLLED, PRESENT EXAMPLE | 0.004 | 130 μm |
| THE CONDITIONS NOT CONTROLLED, COMPRATIVE EXAMPLE | 0.008 | 137 μm |

As artisans may imagine from the above mentioned examples, that the electrostatic potential Vh is set higher potential Vh1 in the case of the glossary recording material is also advantageous to keep thin lines thin in the copied or printed image even after the image is fixed on the glossy recording material. This advantage is due to the following reason.

That is to say, considering the thin lines, although the width of optically exposed area on photoconductive drum would not change even the electrostatic potential Vh is set higher potential Vh1 than the potential Vh0 in the non-glossary recording material case, the width of the area where the surface potential is decreased below the DC voltage Vdc so as to be developed by the toner would be made narrower by setting the higher electrostatic potential Vh1, because the electric potential gradient can be observed between the exposed area and non-exposed area. In this regard, the raising amount of the electrostatic potential (=Vh1−Vh0) may be set in a range from 70(V) to 150(V). More preferably, the raising amount may be 100(V).

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An electrophotographic image forming apparatus for forming toner image onto a recording material comprising:

a photoconductor;

an electrostatic charger to charge the photoconductor at an electrostatic potential;

an exposing device to form an electrostatic latent image on the photoconductor by exposing the charged photoconductor;

a developing device to develop the electrostatic latent image on the photoconductor with toner by applying a development bias so as to form a toner image;

a transferring device to transfer the formed toner image onto a recording material;

a fixing device to fix the toner image on the recording material; and a controller to control the electrostatic potential, the controller controlling a difference between the electrostatic potential and developing bias to be higher in the case that glossiness of the recording material is high than in the case that glossiness of the recording material is low.

2. The electrophotographic image forming apparatus of claim 1, wherein the glossiness is detected by a glossiness detection sensor which detects glossiness of the recording material.

3. The electrophotographic image forming apparatus of claim 1, wherein the glossiness is input by an operator from a designating member enabling to designate the kind of recording material having various glossiness.

4. The electrophotographic image forming apparatus of claim 1, wherein the toner has volume mean particle size in a range from 4 μm to 8 μm.

5. The electrophotographic image forming apparatus of claim 1, wherein the glossiness detection sensor is provided above a recording material housing member.

6. An electrophotographic image forming apparatus for forming toner image onto a recording material comprising:

a photoconductor;

an electrostatic charger to charge the photoconductor;

an exposing device to form an electrostatic latent image on the photoconductor by exposing the charged photoconductor;

a developing device to develop the electrostatic latent image on the photoconductor with toner by applying a development bias in which AC voltage is superimposed on DC voltage so as to form a toner image on the photoconductor;

a transferring device to transfer the formed toner image onto a recording material;

a fixing device to fix the toner image on the recording material; and a controller to control the development bias, the controller controlling frequency of the AC voltage according to glossiness that the recording material has.

7. The electrophotographic image forming apparatus of claim 6, wherein the controller controls the frequency to be higher in the case that glossiness of the recording material is high than in the case that glossiness of the recording material is low.

8. The electrophotographic image forming apparatus of claim 6, wherein the glossiness is detected by a glossiness detection sensor which detects glossiness of the recording material.

9. The electrophotographic image forming apparatus of claim 6, wherein the glossiness is input by an operator from a designating member enabling to designate the kind of recording material having various glossiness.

* * * * *